United States Patent [19]

Ellert

[11] 4,386,636

[45] Jun. 7, 1983

[54] CONTAINER CONVEYOR FOR FLEXIBLE CONTAINER FILLING MACHINE

[75] Inventor: Roger H. Ellert, San Clemente, Calif.

[73] Assignee: Scholle Corporation, Irvine, Calif.

[21] Appl. No.: 245,394

[22] Filed: Mar. 19, 1981

[51] Int. Cl.[3] ..... B65B 3/04

[52] U.S. Cl. ..... 141/10; 141/114; 141/313; 53/469

[58] Field of Search ..... 141/10, 114, 313–317, 141/283, 372; 53/467, 468, 469, 470, 268–275, 281, 282, 283, 300, 381 A, 187, 266, 434, 512

[56] References Cited

U.S. PATENT DOCUMENTS 4,120,134 10/1978 Scholle ..... 141/114

*Primary Examiner*—Houston S. Bell, Jr.
*Attorney, Agent, or Firm*—Knobbe, Martens, Olson, Hubbard & Bear

[57] ABSTRACT

Apparatus for advancing flexible containers that are connected together seriatim in a continuous row, automatically, to a filling and capping station by preliminarily moving the filling spout of each container to a position adjacent the filling nozzle during the filling of the next previous container. Because the containers are flexible, excess container material forms a loop between the container spout at the filling station and the container spout at the pre-positioning station, and does not interfere with the filling operation, particularly since the empty flexible containers can be supported as they are advanced toward the filling station by guides which capture the filling spout itself.

When a container is full, it is released from the filling nozzle and the filling spout of the next adjacent succeeding container, having been positioned close to the filling nozzle location, can be immediately positioned in the filling nozzle, avoiding the delays inherent in accelerating a complete line of waiting empty containers the full distance of one container's length. The apparatus thus takes advantage of the flexible nature of the containers to permit a reduction in the lag time between the capping of one container and the filling of the next container.

28 Claims, 8 Drawing Figures

Fig. 1
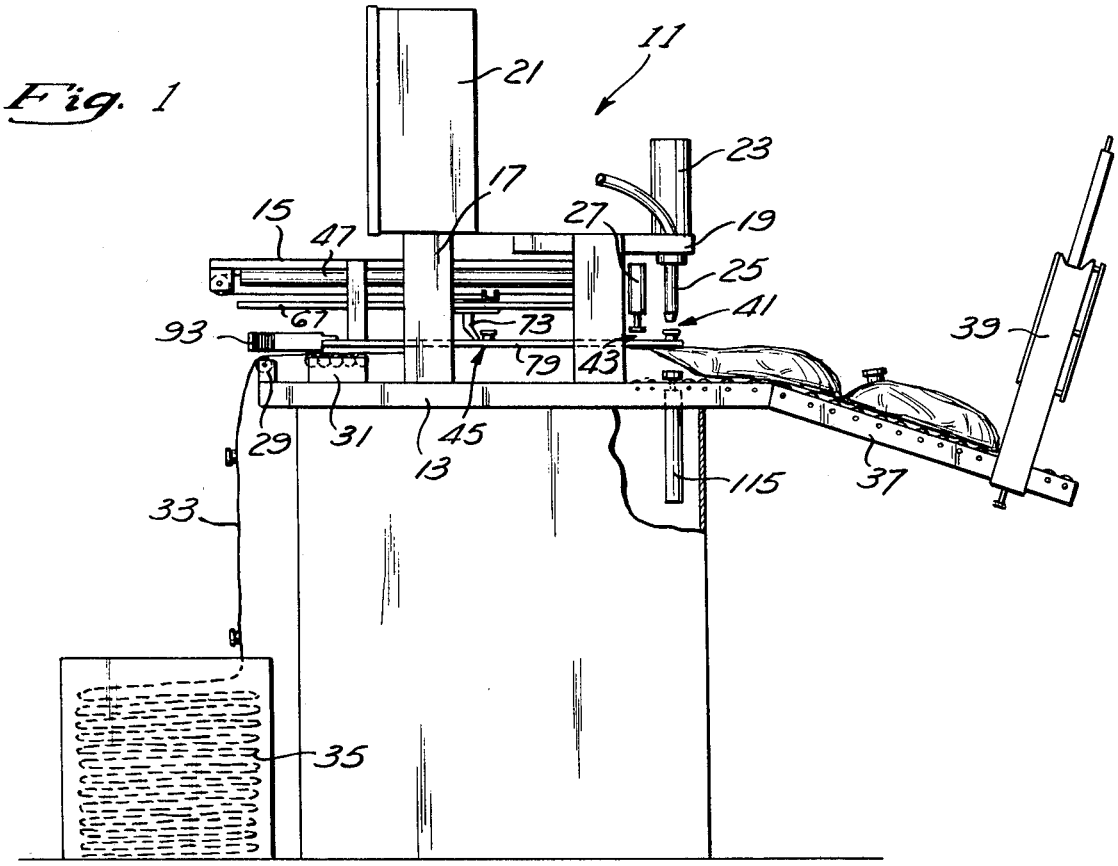
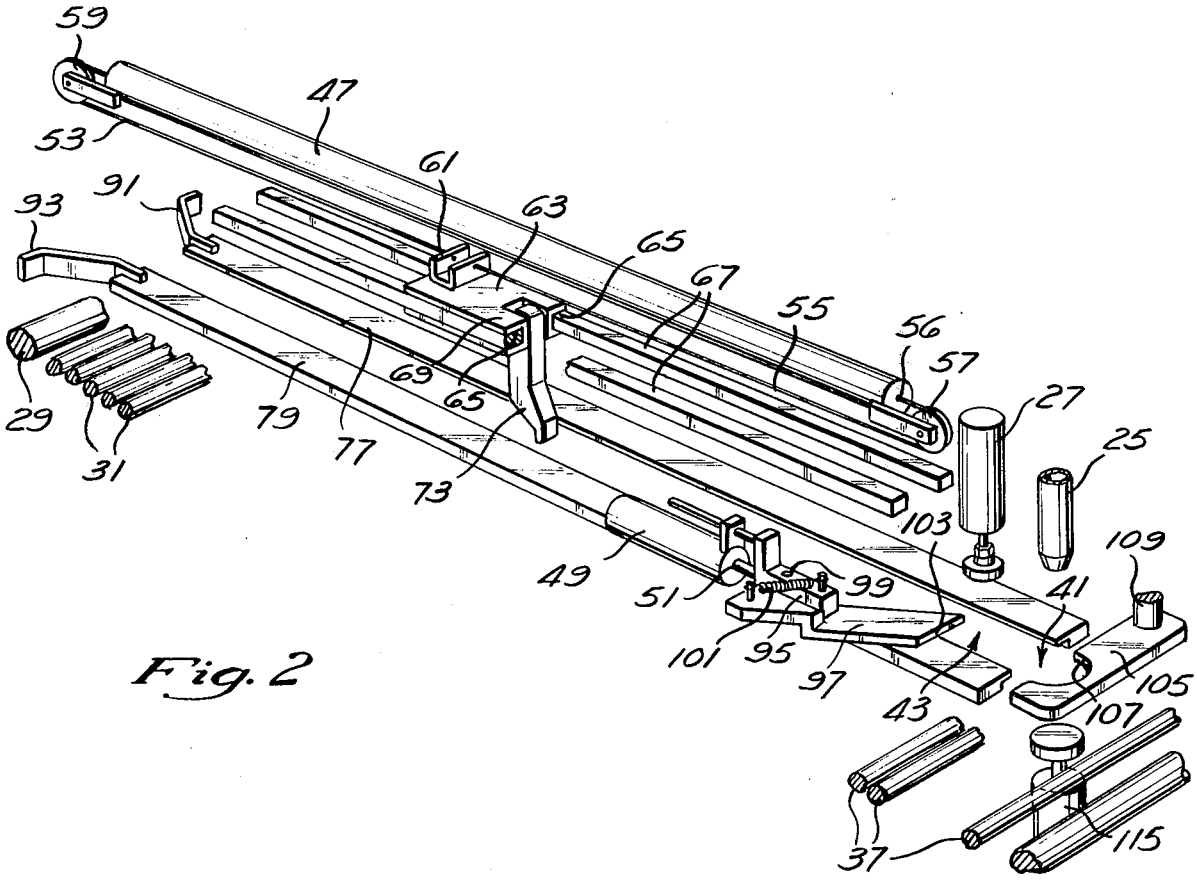
Fig. 2

59
61
63
47
67
29
79
77
73
27
25
31
45
43
41
109
33
49
105
151a
151c
101
97
103
151b
115
37
95
151d
99
135
107

CONTAINER CONVEYOR FOR FLEXIBLE CONTAINER FILLING MACHINE

BACKGROUND OF THE INVENTION

The present invention relates to improvements in apparatus and methods of filling flexible containers and, in particular, to improvements in apparatus for advancing the filling spouts of such containers into a filling station in an apparatus designed to handle containers connected together seriatim in a continuous row.

This invention is an improvement over the apparatus which is described in U.S. Pat. No. 4,120,134, which issued Oct. 17, 1978, to William R. Scholle, and is assigned to Scholle Corporation. The specification of that patent provides useful background information helpful in understanding the context in which the present invention operates and, for this reason, that patent is hereby incorporated herein by reference.

As described in U.S. Pat. No. 4,120,134, the prior art provides filling equipment which includes (a) conveyors for directing the continuous web formed by interconnected containers from a supply carton or other location onto a platform adjacent the filling station; (b) guides for aligning the filling spout of each container as it moves along the platform; (c) a mechanism for uncapping each container if it is capped during empty shipment, filling the container, and replacing the cap to seal the container; (d) a mechanism to seal off the spout and thereby exclude foreign matter from the container during the time between removal of the filling nozzle and capping of the filled container; and (e) means for holding each successive filling spout in position beneath the filling nozzle and for releasing such filling spouts after each container is filled. As described in this patent, the container at the filling location rests either on a driven conveyor or on an inclined passive conveyor so that, as each filling spout is capped and released at the filling station, the filled container is transported away from the filling station, either by gravity or by operation of the power conveyor, and pulls with it the web of empty interconnected containers behind it.

In either of these embodiments, a substantial time lapse occurs between the release of one filling spout and the engagement of the next adjacent filling spout at the filling station. Thus, in the case of the gravity driven embodiment, when a filled container is released at the filling station, there is a lapse of time as the filled container accelerates down the inclined passive conveyor, and this acceleration is restricted, not only by the mass of the continuous web attached to the filled container, but also by the inertia of rotating guide members and the friction between the continuous web of material and the guide elements which guide the web from the supply container to the machine platform.

The use of a power conveyor may increase the acceleration of the filled container away from the filling station to some extent, but even with this embodiment, there is a significant time lag between the release of a first filling spout and the engagement of the next successive filling spout at the filling station, reducing the overall efficiency of the equipment and the speed at which a continuous web of containers may be filled.

SUMMARY OF THE INVENTION

The present invention alleviates this problem associated with the prior art by exerting individual control over each successive filling spout as it approaches the filling station, independent of the motion of an adjacent filling spout at the filling station. Thus, the present invention takes advantage of the flexible character of the unfilled continuous web of interconnected containers by manipulating the filling spouts and allowing the flexible web material to loop, as necessary, to accommodate such independent movement.

More specifically, the present invention provides a guide, leading to the filling station, which reciprocally supports and aligns each filling spout after it has been drawn onto the filling machine from the supply container, and a pair of independently actuated reciprocating spout drivers, one having a relatively short reciprocating stroke, and the other having a relatively long reciprocating stroke. The long stroke spout driver advances each filling spout from the beginning of the spout guide to a ready position adjacent the filling station, drawing the continuous web from the supply container onto the filling machine and guiding the next successive filling spout into the guide. This movement is undertaken while the short stroke spout driver is abutted against a spout which is captured at the filling nozzle and while the flexible container, related to this spout, is being filled with liquid. Thus, the duration of the fill is utilized to advance the continuous web of material from the supply container and over any necessary conveying and aligning means so that, while a first container is being filled, the spout of the next adjacent container is brought to the ready position.

At the ready position, the cap on the waiting spout may be aligned to avoid misalignment within the filling mechanism. The web of material between the filling spout of the filling station and that at the ready station is allowed to form a loose loop beneath the alignment guide.

With the container at the filling station still undergoing a filling operation, the short stroke spout driver is retracted to a position behind the spout at the ready position to hold this spout in the ready position so that the long stroke spout driver may be retracted to engage the next successive spout.

As soon as the spout in the filling station is capped and released by the filling station, both the short stroke spout driver and the long stroke spout driver are advanced to push the spout from the ready station to the filling station. During this movement, the continuous web of material, trailing the spout at the ready station, must be driven forward by both the short stroke spout driver and the long stroke spout driver, in tandem, but the distance moved is so short that there is no significant delay between the time of release of the filled container and the engagement of the container advanced from the ready station, so that the filling operation may be virtually continuous.

When the filled container is released at the filling station, and the next spout is advanced from the ready station, the flexibility of the loop in the continuous web of material between the filled container and the spout advancing into the filling station allows independent motion of the container spouts and permits the filling of the spout advanced from the ready station to be initiated immediately, even though the filled container has not moved far enough along its conveyor, away from the filling station, to stretch the loop in the web of material taut.

BRIEF DESCRIPTION OF THE DRAWINGS

These and other advantages of the present invention are best understood through reference to the drawings, in which:

FIG. 1 is a simplified, overall, elevation view of the flexible container filling apparatus embodying the container advancing mechanism of the present invention;

FIG. 2 is a schematic, perspective view of the container advancing mechanism of the present invention removed from the apparatus of FIG. 1 and showing the essential elements thereof;

DETAILED DESCRIPTION OF THE PREFERRED EMBODIMENT

Figure 3A:
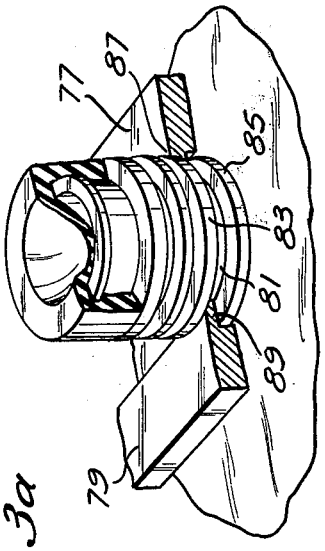
FIG. 3A is a partial perspective view showing the interrelationship of a filling spout and the spout guide of the invention.

Referring initially to FIG. 1, a flexible container filling apparatus 11 of the present invention includes a primary support frame 13 and secondary elevated support frames 15, 17, and 19, each supported from the primary support frame 13 by upstanding posts.

The secondary support frame 17 supports an electrical and pneumatic sequencing and control panel 21 which controls the operation of the apparatus 11. The secondary support frame 19 supports a filling nozzle 23 and an associated capping and uncapping apparatus 25.

The secondary support frame 15 supports the container guiding and advancing mechanism for the present invention.

The primary support frame 13 additionally mounts first and second roller frames 29 and 31, which guide the continuous web of interconnected containers 33 from a storage location, such as a box 35, onto the bed of the apparatus 11. In addition, the primary support frame 13 supports an inclined container unloading conveyor 37, which is used to advance filled containers, by gravity, to a container separator 39. The container separator 39 serves to disconnect adjacent filled containers 33 at perforations preformed in the container web between adjacent containers 33, so that the containers 33 may be deposited into protective enclosures, such as cardboard boxes, as by using the mechanism described in patent application Ser. No. 160,556, filed June 17, 1980, Roger H. Ellert, inventor. This latter mechanism is not shown in FIG. 1.

For ease in correlating the description in regard to the various figures, the location designated 41 (at which a container filling nozzle 23 is located), will be designated the filling station. Likewise, the location 43 will be designated the ready station and the location 45 will be designated the pick up station.

Figure 3:
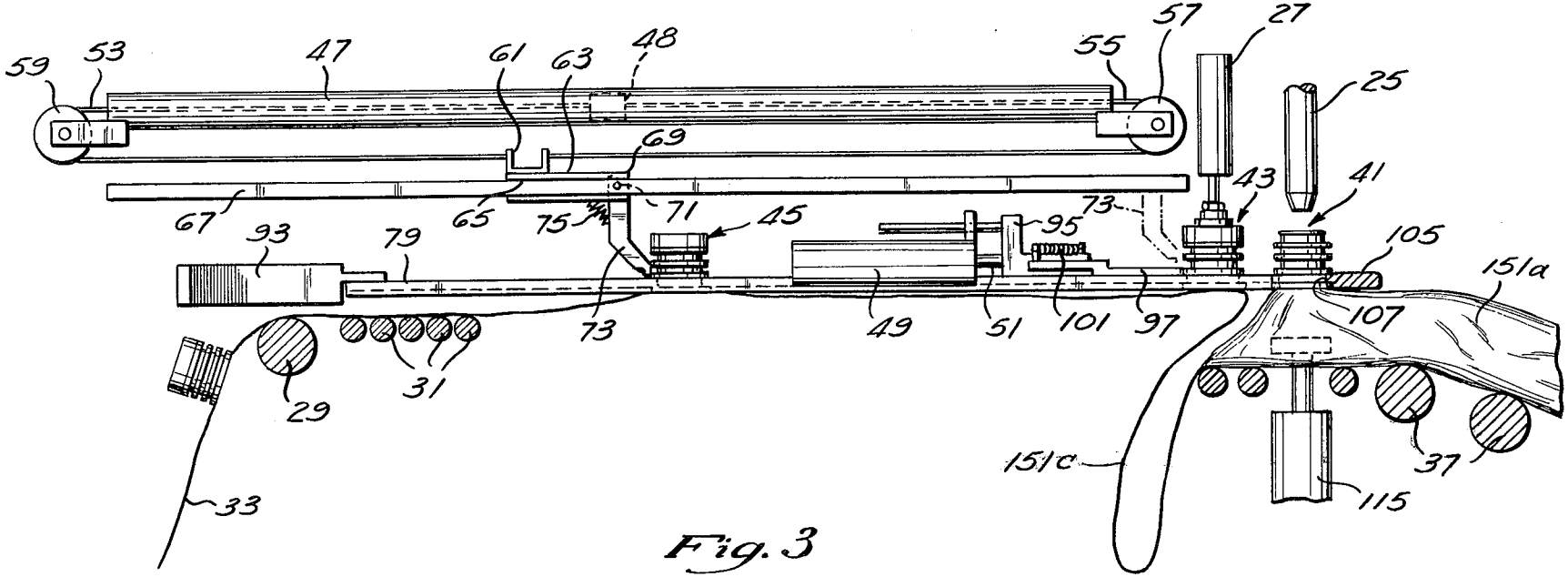
FIG. 3 is an elevation view of the container advancing portion of the filling machine of FIG. 1.

The details regarding the mechanism supported from the secondary support frame 15, utilized to advance container filling spouts 34 to stations 45, 43, and 41, are best understood by reference to FIGS. 2 and 3. This mechanism includes a first long stroke pneumatic cylinder 47 and a second short stroke pneumatic cylinder 49. While the short stroke cylinder 49 is of typical form, including an enclosed piston (not shown) attached to an actuating rod 51, the long stroke cylinder 47 houses a relatively short piston 48 sealed to the inside diameter of the cylinder 47 and attached at opposite ends to a pair of cables 53 and 55. The cables 53,55 are sheathed in smooth, plastic tubes, and thus seal at the ends of the cylinder 47 within sealing grommets 56. Thus, pressure applied to opposite ends of the cylinders 47 will drive the piston within the cylinder, pulling one of the cables 53,55 through its associated seal 56, and allowing the remaining cable 53,55 to exit through its associated seal 56. The cable 55 is guided coaxially through the seal 56 by a first pulley 57, while the cable 53 is guided in a similar fashion by a pulley 59.

The cables 53,55 terminate at an upstanding U-shaped bracket 61 mounted on a guide block 63.

The guide block 63 includes opposed grooves 65 which mate with a pair of guide rods 67 rigidly mounted on the secondary support frame 15. These guide rods 67 provide bearings for the grooves 65 to permit axial reciprocation of the guide block 63, under control of the long stroke cylinder 47. The cable arrangement 53,55 permits the reciprocating stroke of the guide block 63 to be substantially equal in length to the overall length of the long stroke cylinder 47, obviating the need for a long piston rod extending beyond the long stroke cylinder 47 in a more typical assembly.

The leading end of the guide block 63 forms a clevis 69 in which a pin 71 provides rotational support for a long stroke reciprocating spout driver 73. The long stroke spout driver 73 is held in the position shown in FIGS. 2 and 3 against a stop in the guide plate 63 by a spring 75, but may be rotated counterclockwise, as viewed in these figures, if the bias of the spring 75 is overcome.

The lower extremity of the spout driver 73 reciprocates within a channel formed between a pair of guide plates 77 and 79, which are rigidly mounted on the secondary support frame 15. The filling spouts 34 of the flexible containers 33 handled by this apparatus include circumferential grooves 81 (FIG. 3A), one of these grooves 81 formed between a pair of annular flanges 83,85. The channel between the guide rods 77,79 is narrower than the outside diameter of the annular flanges 83,85, but wider than the groove 81. In addition, the guide plates 77,79 are undercut at their inner edge to form respective guide lips 87,89 which fit within the groove 81.

The guide plates 77,79 thus support the upper annular flange 83 of each respective filling spout and thereby support the empty containers as they are advanced along the plates 77,79. In addition, contact of the lips 87,89 with the groove 81 guides each respective filling spout along the channel between the plates 77,79.

The leading ends of the guide plates 77,79 are rigidly connected to converging alignment plates 91 and 93, respectively. These plates 91,93 cooperate with the rollers 29,31 to guide flexible containers and their associated filling spouts 34 from the container or other source 35 into the previously described engagement with the alignment plates 77,79.

The piston rod 51 of the short stroke pneumatic cylinder 49 includes a clevis 95 which mounts a short stroke spout driver 97. The spout driver 97 is permitted to rotate within the clevis 95 about a pin 99 and is urged for rotation in a counterclockwise direction, as viewed in FIG. 2, about the pin 99 by a biasing spring 101. The clevis 95 includes a stop (not shown) which limits such counterclockwise rotation to the position shown in FIG. 2, with a spout engaging leading edge 103 of the spout driver 97 extending across the channel formed between the alignment plates 77,79. When fully retracted, the piston rod 51 moves the spout abutting edge 103 to a position, as shown in FIGS. 2 and 3, which permits a container spout engaging the edge 103 to rest at the ready station 43. When the piston rod 51 is fully extended, the engaging edge 103 will rest immediately adjacent the filling station 41.

At the filling station 41, a container spout support plate 105 cooperates with the trailing edge of the guide plates 77,79 so that a spout, which is advanced to the filling station 41, will rest, with the groove 81 captured within a semicircular opening 107 in the plate 105 during the filling operation. The plate 105 is mounted for rotation about an axle 109 between a first position, as shown in FIG. 2, for receiving a spout and supporting the spout during the filling operation, and a second position, rotated counterclockwise, as viewed in FIG. 2, about the axle 109, which second position releases the spout from the semicircular opening 107 to permit the container 33 to exit the filling apparatus 11 along the conveyor 37 (FIG. 1).

Figure 7:
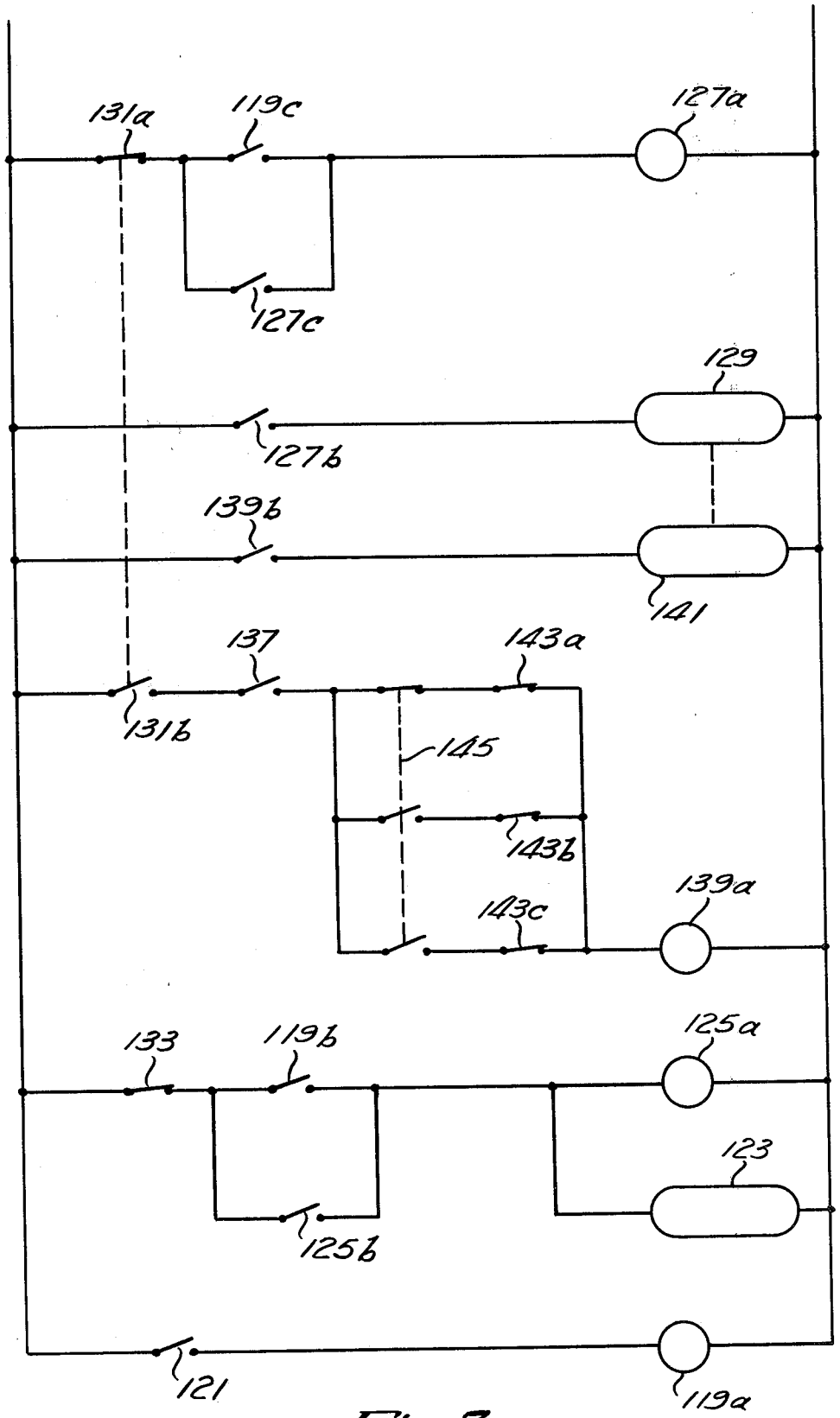
FIG. 7 is an electrical schematic drawing of the control circuit used for automatically sequencing the apparatus of FIGS. 2 through 6.

FIG. 7 is a schematic diagram of the electric sequencing control system, located in the cabinet 21 (FIG. 1) and pneumatic solenoid valves used to control the spout advancing mechanism of the present invention. This schematic diagram will be described in combination with FIGS. 2, 4, 5, and 6, which illustrate the mechanical sequence of operations of the equipment.

Referring initially to FIGS. 2 and 7, the long stroke spout driver 73 is initially fully retracted and abutted against a container spout 34 at the pick up station 45. The short stroke spout driver 51 is fully retracted, abutting against an adjacent spout at the ready station 43. The spring 101 maintains the short stroke spout driver 97 extended across the channel between the plates 77 and 79 to hold his spout in position. Similarly, the spring 75 (FIG. 3) holds the long stroke spout driver 77 in position, as shown, against a stop and behind the spout at the pick up station 45. During the time that the spout has been at rest at the ready station 43, a precapping device 27 has secured the cap, previously in a dust cover position, onto the spout, to assure alignment of the cap with the spout as the spout enters the filling station 41. The plate 105 has previously been rotated counterclockwise, as viewed in FIG. 2, about the axle 109 so that the semicircular opening 107, which has been engaging a previously filled spout, rotates away from that spout releasing the previous container.

After release of this previous container, the plate 105 rotates clockwise about the axle 109, closing a normally open limit switch, identified on FIG. 7 as 121. The limit switch 121 is not shown on the mechanical drawings, but its position, and that of the other limit switches described below, will be apparent from the functional description of each. The same is true of the solenoid valves to be described. Closure of this limit switch 121 energizes the coil **119*a* of a relay, closing contacts 119*b*. Closure of the contacts 119*b* energizes a solenoid valve 123 which supplies pressure to the pneumatic cylinder 49 to advance the short stroke spout driver 97 to the position shown in FIG. 4. This activation of the short stroke spout driver 97 advances the precapped spout from the ready station 43 to the filling station 41, where the spout is engaged by the filling mechanism and automatically uncapped and filled by the nozzle 25. Between the time that the plate 105 has rotated to the clockwise position, shown in FIGS. 2 and 4, and the time that a next spout is advanced by the short stroke spout driver 97, so that the next succeeding spout is ready for filling, only a very short time elapses, since the stroke of the cylinder 49** is relatively short.

Closure of the contacts **119*b* likewise actuates a relay coil 125*a*, which closes contacts 125*b* in parallel with contacts 119*b*. This latches the solenoid 123 to maintain the cylinder 49 extended, regardless of the condition of the contacts 119*b***.

Figures 4, 5, 6:
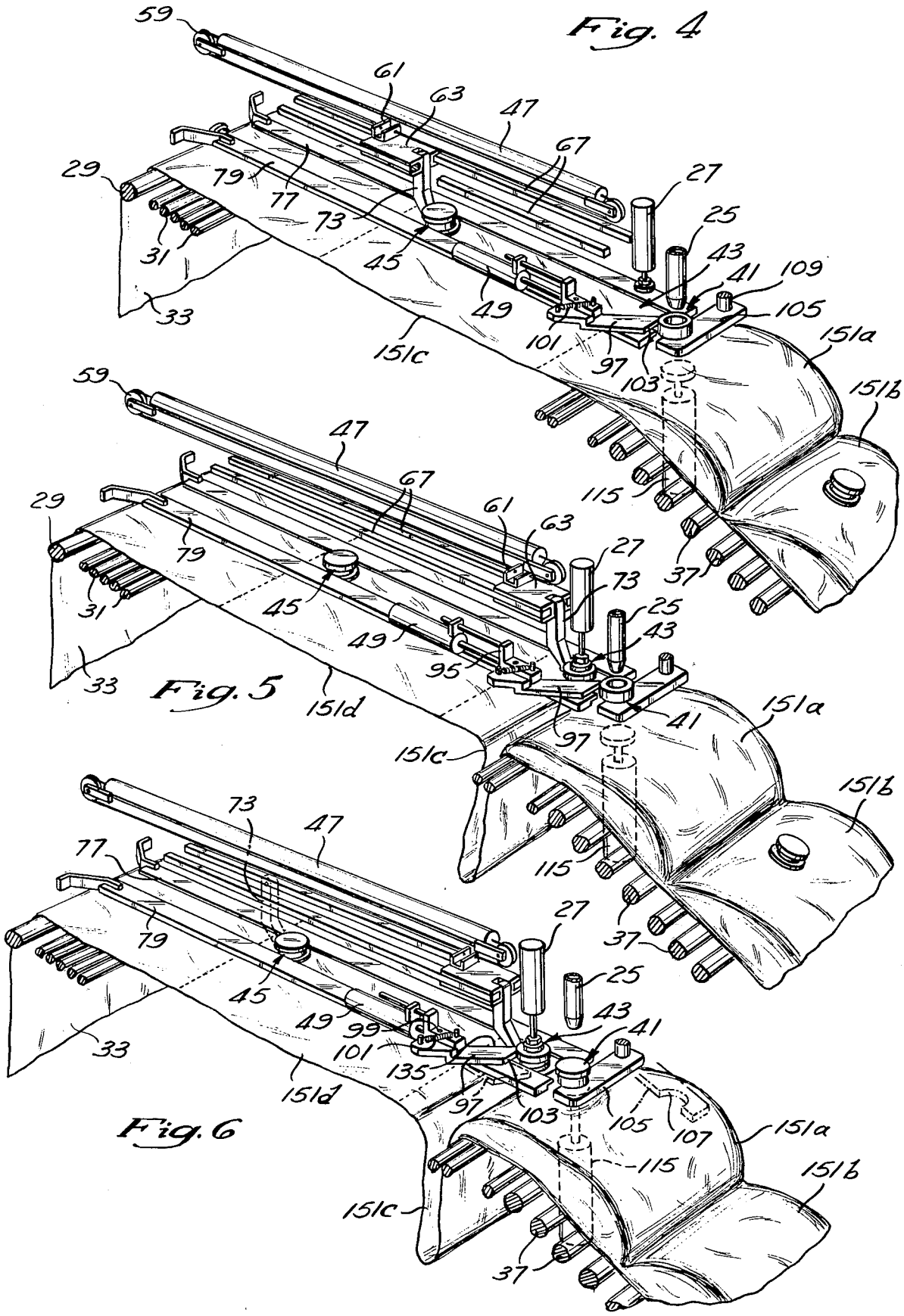
FIGS. 4, 5, and 6 are schematic, perspective views, greatly simplified, showing the sequential operation of the container advancing mechanism to provide the advantages of the present invention.

Energization of the relay coil **119*a*, which causes the above-described advancement of the short stroke spout driver 97, likewise causes closure of switch contacts 119*c* which, in turn, activates a relay coil 127*a*. This relay coil 127*a* closes switch contacts 127*b* to activate a solenoid control valve 129 connected to the long stroke cylinder 47. The solenoid valve 129 advances the cylinder 47 and thus advances the long stroke spout driver 73 to the position shown in FIG. 5, driving a spout 34 from the pick up station 45 to the ready station 43. This action also pulls the next successive spout to the pick up station 45. The relay 127*a* is self-latching, closing switch contacts 127*c* to maintain the coil 127*a* activated regardless of the condition of the switch 119*c*. Once the long stroke spout driver 77 has advanced to the position shown in FIG. 5, it contacts limit switch, opening the switch 131*a* and closing the switch 131*b*. Opening of the switch 131*a* deactivates the relay 127*a* so that the long stroke cylinder 47 remains at rest at the position shown in FIG. 5. The long stroke cylinder 47 is double acting, and must be activated in each direction. Thus, with the removal of pneumatic supply caused by activation of the limit switch 131*a*, the long stroke cylinder 47 will remain at rest. Thus, at the completion of this stage of operation, as shown in FIG. 5, the long stroke spout driver 77 is adjacent a spout in the ready station 43 and the short stroke spout driver 97 remains advanced against an adjacent spout in the filling station 41. During this time period, filling of the container at the filling station 41** is in progress.

Commencement of container filling at the nozzle 25 opens a normally closed switch 133, deactivating the solenoid valve 123 and reversing the pneumatic pressure within the short stroke cylinder 49. The short stroke cylinder 49 is a double acting cylinder, and opening of the switch contacts 133 deactivates the valve 123 to drive the short stroke spout driver 97 to the retracted position shown in FIG. 6. As the short stroke spout driver 97 is retracted, the long stroke spout driver 73 remains in its rest position, as shown in FIG. 6, holding the spout in the ready position 43.

This retraction of the short stroke spout driver with a spout at the ready position 43 rotates the short stroke spout driver 97 clockwise, as viewed in FIG. 6, cammed to this clockwise position by a camming surface 135 which bears against the spout in the ready position 43. This rotation overcomes the bias of the spring 101, rotating the spout driver 97 about the pin 99. As soon as the cylinder 49 has retracted to place the leading edge 103 of the short stroke spout driver 97 behind the spout at the ready position 43, the spring 101 snaps the short stroke spout driver 97 in a counter-clockwise direction, placing the leading edge 103 across the channel formed by the plates 77 and 79, so that the short stroke spout driver 97 can hold the spout in the ready position 43.

The rotated position of the spout driver 97 is shown in phantom in FIG. 6.

At the end of this operation, the long and short stroke spout drivers 73,97 are in the position shown in FIG. 6. Retraction of the short stroke cylinder 49 closes a normally open limit switch 137 activating a relay coil 139*a* to close contacts 139*b*, activating a solenoid 141 which supplies pressure to the end of the long stroke cylinder 47 opposite to that connected to the solenoid valve 129. This retracts the long stroke spout driver 73 to the position shown in FIG. 2 (and in phantom in FIG. 6), while the short stroke spout driver 97 holds the spout at the ready position 43 and thus holds the web of continuous containers waiting to be filled in position. As the long stroke spout driver 77 is retracted, it engages a spout at the pick up station 45 and is rotated by this spout, overcoming the bias of the spring 75, so that the spout driver 77 slides over the spout at the ready position 45 and then, urged by the spring 75, snaps back into its normal position, as shown in FIG. 2, behind the spout at the ready position 45.

Movement of the long stroke spout driver 77, in the retracting direction, is arrested by actuation of one of three limit switches 143*a*, 143*b*, or 143*c*. These three limit switches are placed at different locations along the length of the guide rods 67 to accommodate flexible containers of different lengths. The length of the containers being filled at a particular time is selected by a three-way switch 145 which permits one of the three normally closed limit switches 143*a* through 143*c* to be effective in limiting the retraction of the long stroke spout driver 73. Opening of the appropriate limit switch 143*a* through 143*c* deactivates the relay coil 139*a*, opening the contacts 139*b*, and thus deactivating the solenoid valve 141 to leave the long stroke cylinder 47 at rest behind the spout in the ready position 145. It will be recognized, of course, that the normally open switch 131*b*, previously closed as the switch 131*a* was opened, has allowed activation of the relay coil 139*a*. Return of the long shuttle to its fully retracted position, opens the switch 131*b* and closes the switch 131*a*, setting the circuit for a repeated automatic cycle identical to that just described.

The movement of the continuous web of interconnected containers 33 and their associated spouts in response to the above-described operation of the long and short stroke spout drivers 73,93, respectively, will now be described, in reference to FIGS. 4, 5, and 6. Beginning with FIG. 4, a container 151*a* is being filled by the nozzle 25 while an adjacent container 151*b*, previously filled, rests on the inclined conveyor 37. The web of container material between the container 151*a* and the next adjacent container 151*c* is stretched relatively tight by the web of material leading to the supply carton 35 (FIG. 1). As the long stroke spout driver 73 advances to the position shown in FIG. 5, the body of the flexible container 151*c* forms a loop, as shown in FIG. 5, below the plane formed by the guide plates 77 and 79 along which the container spouts travel. This loop of material allows the long stroke spout driver 77 to move the spout of the container 151*c* to the ready station 43 immediately adjacent the filling station 41, so that the precapper 27 can adjust the cap on the container 151*c*. This forward motion of the container 151*c* moves the continuous web of material behind it, withdrawing an additional container from the supply carton 35 and moving the next container 151*d* so that its spout is at the pick up station 45. Thus, the time which elapses during the filling of the container 151*a* is used to advance the containers 151*c*, *d*, etc., forward toward the filling station 41, and to retract the spout drivers 97,73.

As shown in FIG. 6, the container 151*a* is then capped, with a cylinder 115 advanced to exclude foreign material, and the container 151*a* is released from the filling nozzle 25 to roll, by gravity, along the conveyor 37. As soon as the container 151*a* has cleared the filling station 41, the short stroke cylinder 49 is advanced, to the position shown in FIG. 4, to advance the filling spout of the container 151*b* into the filling station 41, requiring only a very short movement of the web of material between the filling station 41 and the supply carton. As the filling of the container 151*b* commences, the loop, previously formed, is slowly eliminated, due to movement of the container 151*a* down the conveyor 37.

It can be seen from the above description that the substantial time lag, which would be inherent in moving the entire web of material a distance equal to the length of a container between filling operations, is eliminated, and only a very short time period, as is required for advancement of the short stroke spout driver 97 from the ready station 43 to the filling station 41, is required before filling of the next container 151*b* can commence.

What is claimed is:

1. Apparatus for advancing a web of connected, flexible containers, each having a filling spout, toward a filling station of a container filling machine, to place the filling spout of each container, sequentially, into fluid communication with a filling nozzle at said filling station, comprising:

first means for advancing said web to advance the filling spout of a second one of said containers to a ready station, adjacent said filling station, while the filling spout of a first one of said containers is in fluid communication with said filling nozzle; and second means for advancing said filling spout of said second one of said containers from said ready station to said filling station immediately after release of said filling spout of said first container from said filling station.

2. Apparatus for advancing a web of containers, as defined in claim 1, wherein said means for advancing said web to a ready station comprises:

switching means for selecting the length of containers to be filled; and means responsive to said switching means for advancing said web different distances to said ready station to accommodate different size containers.

3. Apparatus for advancing a web of flexible containers, as defined in claim 1, wherein said first means for advancing said web to a ready station advances the filling spout of a third one of said containers to a pick up station, removed from said filling station by the length of one of said containers.

4. Apparatus for advancing a web of flexible containers, as defined in claim 1, wherein said first means for advancing said web toward a ready station advances said web by the length of one container on said continuous web.

5. Apparatus for advancing a web of flexible containers, as defined in claim 1, wherein said first means for advancing said web to a ready station forms a loop in said web between said ready station and said filling station.

6. A method of advancing a continuous web of flexible, empty, interconnected containers toward a filling station of a container filling machine, comprising the steps of:

advancing the filling spout of a first container to said filling station; and simultaneously (a) filling said first container, and (b) forming a loop in said web between the spouts of said first and a second container to advance said second container, along with said continuous web, to a ready position which will permit rapid filling of said second container on completion of filling of said first container.

7. A method of advancing a continuous web of flexible containers, as defined in claim 6, additionally comprising:

engaging a third container during said filling of said first container with a device used for forming said loop.

8. A method of advancing a continuous web of flexible containers, as defined in claim 6, additionally comprising:

filling said second container while simultaneously removing said loop from said web between the spouts of said first and second container.

9. A method of advancing a continuous web of flexible containers, as defined in claim 6, additionally comprising:

withdrawing additional containers from a source of containers simultaneously with said filling and forming steps.

10. A method for filling a series of interconnected, flexible containers which form a web of flexible material when empty, comprising the steps of:

advancing respective spouts of said containers, seriatim, into a filling device; and looping the web of material between a source of supply of said containers and said filling device to reduce the time delay between the placement of sequential spouts of said containers in said filling device.

11. A method for filling a series of flexible containers, as defined in claim 10, additionally comprising the step of:

supporting said containers from said spouts during said advancing step.

12. A method for filling a series of flexible containers, as defined in claim 11, wherein said supporting step comprises:

guiding said container spouts on a supporting guide positioned along the path of said advancing step.

13. A method for filling a series of flexible containers, as defined in claim 10, wherein said advancing step comprises advancing said respective spouts to three separate positions, one at said filling device and wherein said looping step forms loops of said web material between the first and third positions.

14. Apparatus for advancing a continuous web of interconnected, flexible, empty containers, each having a filling spout, to a filling device for said containers, comprising:

first means for driving the spouts of said containers along a path from a first position removed from said filling device by a distance approximately equal to the length of one of said containers to a second position adjacent said filling device;

second means for driving the spouts of said containers along a path from said second position to a third position at said filling device; and means for advancing said first and second driving means independently to form a loop in said web between said first and third positions.

15. Apparatus for advancing a continuous web of flexible containers, as defined in claim 14, additionally comprising:

means for retracting said first and second driving means independently to pass spouts from said first driving means to said second driving means.

16. Apparatus for advancing a continuous web of flexible containers, as defined in claim 14, wherein each of said first and second driving means drives said spouts in one direction only.

17. Apparatus for advancing a continuous web of flexible containers, as defined in claim 14, additionally comprising:

means for automatically advancing said first driving means to drive said spouts in response to retraction of said second driving means.

18. Apparatus for advancing a continuous web of flexible containers, as defined in claim 17, additionally comprising:

means for automatically advancing said second driving means in response to the completion of filling of a container by said filling device.

19. Apparatus for advancing a continuous web of flexible containers, as defined in claim 14, wherein said means for advancing said first and second driving means selectively forms said loops between said second and third positions and at a location beyond said third position.

20. Apparatus for advancing a continuous web of interconnected, flexible, empty containers to a filling device for said containers, comprising:

a first driving means for advancing the spouts of said containers along a path from a first station displaced from said filling device by a distance at least equal to the length of one of said containers to a second station adjacent said filling device;

a second driving means for advancing the spouts of said containers along a path from said second station to said filling device; and means for independently advancing said first and second driving means at different times.

21. Apparatus for advancing a continuous web of flexible containers, as defined in claim 20, wherein said first driving means is actuated in response to movement of said second driving means.

22. Apparatus for advancing a continuous web of flexible containers, as defined in claim 21, wherein said first driving means advances in response to retraction of said second driving means.

23. Apparatus for advancing a continuous web of flexible containers, as defined in claim 20, wherein said second driving means advances in response to completion of filling of a container at said filling device.

24. Apparatus for advancing a web of connected, flexible containers toward the filling station of a container filling machine, to place the filling spout of each container, sequentially, into fluid communication with a filling nozzle at said filling station, comprising:

a spout guide forming a path toward said filling nozzle; and means for advancing along said spout guide to push one of said filling spouts along said guide toward said filling station and for thereby advancing said web of connected, flexible containers, 25. Apparatus, as defined in claim 24, wherein said spout guide comprises a pair of spaced guide plates, said guide plates cooperating with said spouts to support said spouts while permitting said spouts to advance toward said filling station.

26. A method for advancing a web of connected, flexible containers toward the filling station of a container filling machine, to place the filling spout of each container, sequentially, into fluid communication with a filling nozzle at said filling station, comprising the steps of:

capturing one of said spouts in a guide mechanism; and advancing said web of connected, flexible containers by pushing said one of said spouts along said guide mechanism toward said filling station.

27. Apparatus according to claim 1 further including:

a frame;

a long stroke spout driver connected to said frame, said long stroke spout driver comprising said first means and including means for engaging the filling spout of the second container to move the filling spout of the second container to the ready station; and a short stroke spout driver connected to said frame, said short stroke driver comprising said second means and including means for engaging the filling spout of the second container to advance the filling spout of the second container from the ready station to the filling station after a first container has been moved from the filling station.

28. Apparatus according to claim 27 further including:

means for reciprocally moving said long stroke spout driver relative to said frame to sequentially move container filling spouts to the ready station; and means for reciprocally moving said short stroke spout driver relative to said frame for sequentially moving container filling spouts from the ready station to the filling station.

* * * * *